US005595847A

United States Patent [19]

Nogami et al.

[11] Patent Number: 5,595,847

[45] Date of Patent: Jan. 21, 1997

[54] PHOTOCONDUCTOR HAVING A CURED LAYER OF AN AMINO RESIN-PHENOL RESIN COPOLYCONDENSATE

[75] Inventors: Sumitaka Nogami; Michihiro Kitazawa; Katsuhiro Sato, all of Kawasaki, Japan

[73] Assignee: Fuji Electric Co., Ltd., Kanagawa, Japan

[21] Appl. No.: 361,331

[22] Filed: Dec. 21, 1994

[30] Foreign Application Priority Data

Dec. 27, 1993 [JP] Japan ..... 5-329192

[51] Int. Cl.[6] ..... G03G 5/14

[52] U.S. Cl. ..... 430/64

[58] Field of Search ..... 430/60, 64, 65

[56] References Cited

U.S. PATENT DOCUMENTS

| | | | |
|---|---|---|---|
| 3,861,921 | 1/1975 | Hottmann et al. | 430/275 |
| 4,800,144 | 1/1989 | Ueda et al. | 430/58 |
| 5,173,385 | 12/1992 | Nozomi et al. | 430/60 |

FOREIGN PATENT DOCUMENTS

| | | |
|---|---|---|
| 4411732 | 10/1994 | Germany . |
| 57-81269 | 5/1982 | Japan . |
| 59-93453 | 5/1984 | Japan . |
| 60-32054 | 2/1985 | Japan . |
| 60-111255 | 6/1985 | Japan . |
| 61-110153 | 5/1986 | Japan . |
| 63-116160 | 5/1988 | Japan . |
| 63-116161 | 5/1988 | Japan . |
| 63-116162 | 5/1988 | Japan . |

*Primary Examiner*—John Goodrow
*Attorney, Agent, or Firm*—Spencer & Frank

[57] ABSTRACT

A photoconductor for electrophotography includes an electroconductive substrate; and a photosensitive layer provided on the electroconductive substrate and composed of an intermediate layer, a charge generation layer, and a charge transfer layer laminated in this order, wherein the intermediate layer is a doped layer and is composed of a cured layer of a copolycondensate between an amino resin and a phenolic resin hat has been subjected to doping with at least one dopant.

20 Claims, 1 Drawing Sheet

PHOTOCONDUCTOR HAVING A CURED LAYER OF AN AMINO RESIN-PHENOL RESIN COPOLYCONDENSATE

BACKGROUND OF THE INVENTION

1. Field of the Invention

The present invention relates to an organic photoconductors for electrophotography, and more specifically, to a photoconductor for electrophotography which has an intermediate layer.

2. Description of the Prior Art

A photoconductor for electrophotography (hereinafter referred to as a photoconductor) basically comprises a photosensitive layer on a conductive substrate. Generally, however, it has an intermediate layer in order to improve adhesion between the conductive substrate and the photosensitive layer, to inhibit charge injection from the conductive substrate into the photosensitive layer, and to cover defects in the surface of the conductive substrate.

As such an intermediate layer of an inorganic type is known an Alumite layer. Japanese Patent Application Laying-open Nos. 116,160/1988, 116,161/1988 and 116,162/1988, and U.S. Pat. No. 4,800,144, for example, disclose that an Alumite layer with a thickness of several micrometers provided on an aluminum substrate is a layer having stable barrier characteristics which inhibit the injection of charges from the conductive substrate into the photosensitive layer without undergoing little influence from environmental changes.

As organic materials for the intermediate layer have hitherto been known polyvinyl alcohol, casein, and alcohol-soluble nylon.

The characteristics required of the intermediate layer include the ability to upgrade image quality by enhancing adhesion between the photosensitive layer and the conductive substrate, and improving the applicability of the photosensitive layer onto the conductive substrate by covering the surface defects of the conductive substrate. The characteristics required first of all are satisfactory electrical characteristics for a photoconductor, namely, high sensitivity and low residual potential. To achieve these desired characteristics, the above-mentioned intermediate layer of the organic type generally is made of a resin having low resistance itself. This type of intermediate layer is also required to have electrical characteristics unaffected by the environment. However, most of intermediate layers from the aforementioned organic materials are apt to be affected easily by environmental factors, especially humidity. Under low-humidity conditions, their resistance becomes high, causing fog to the resulting image. At high humidity, their resistance becomes too low, and charge potential lowers, decreasing image density. Thus, the intermediate layer using such resin is generally coated with a very small thickness of, say, 0.1 to 1 μm. Such a thin film, needless to say, has a low effect of covering the defects present in the conductive substrate.

To overcome the above drawbacks, an organic type intermediate layer which functions fully even with a large thickness is under energetic development. For instance, Japanese Patent Application Publication Nos. 42,498/1987, 19,869/1988, 51,183/1989, 51,185/1989 and 60,177/1990 exemplify intermediate layers with a large thickness having a conductive fine powder dispersed in various resins. The electric conduction of these exemplified intermediate layers is attributed to electronic conduction by the conductive fine powder. Hence, even though they have a large thickness, they are assumed to show satisfactory electrical conductivity and undergo minimal influence from temperature and humidity. However, the dispersions of the conductive fine powder are subject to the precipitation or agglutination of the conductive fine powder, thus requiring careful administration of the dispersions. Furthermore, a considerable amount of the conductive fine powder has to be incorporated in the coating with the aim of imparting sufficient conductivity. As a result, the surface smoothness of the intermediate layer vanishes, and the injection of charges from the intermediate layer into the photosensitive layer is apt to occur easily. In order to give smoothness to the intermediate layer, there is further need to provide a thin layer of a resin, such as nylon or casein, onto it.

According to the above-described prior art, the intermediate layer particularly of the organic type must be able to upgrade image quality based on the improvement of adhesion between the photosensitive layer and the conductive substrate, and the improvement of the applicability of the photosensitive layer onto the conductive substrate by covering the surface defects of the conductive substrate. To fulfill this requirement, there has been proposed a method which comprises dispersing a conductive fine powder in various resins to form intermediate layers with a large thickness. However, dispersions of the conductive fine powder are subject to the precipitation or agglutination of the conductive fine powder, thus posing difficulty with the administration of the dispersions, and involving viscosity changes due to coagulation. Consequently, the surface smoothness of the intermediate layer disappears, thus arousing a new problem that a thin layer of a resin must be provided on the intermediate layer.

SUMMARY OF THE INVENTION

An object of this invention is to provide a photoconductor for electrophotography having a novel organic intermediate layer.

Another object of the invention is to provide a photoconductor for electrophotography having an intermediate layer which is free from a conductive fine powder and on which a thin layer of a resin need not be provided.

Still another object of the invention is to provide a photoconductor for electrophotography having an intermediate layer which is so stable as to undergo no influence from the environment and which ensures good adhesion between a photosensitive layer and a conductive substrate.

In an aspect of the present invention, there is provided a photoconductor for electrophotography comprising a photosensitive layer on a conductive substrate, the photosensitive layer comprising at least an intermediate layer, a charge generation layer, and a charge transfer layer laminated in this order, wherein the intermediate layer comprises a cured layer of the copolycondensate between an amino resin and a phenolic resin that has been subjected to doping.

Here, the amino resin may be at least one member selected from the group consisting of melamine resins, urea resins and benzoguanamine resins.

The phenolic resin may be a resol type phenolic resin.

The phenolic resin may be the condensate between furfural and formalin.

The doping may be performed using at least one dopant selected from the group consisting of halogen-derived substances and sulfonic acid compounds.

The dopant may be iodine.

The dopant may be an organic sulfonic acid.

The organic sulfonic acid may be α-naphthalenesulfonic acid.

The organic sulfonic acid may be p-toluenesulfonic acid.

The amino resin and the phenolic resin may be in such proportions that the amount of the phenolic resin is 10 to 50 parts by weight with respect to 100 parts by weight of the amino resin.

The proportion of the iodine may be 4 to 10% by weight based on the total resin content.

The proportion of the α-naphthalenesulfonic acid may be 2 to 50% by weight based on the total resin content.

The proportion of the p-toluenesulfonic acid may be 10 to 40% by weight based on the total resin content.

The intermediate layer may further contain a powder selected from the group consisting of titanium oxide, zinc oxide, silica, kaolin, calcium carbonate, and fine plastic particles.

The thickness of the intermediate layer may be 0.2 to 20 μm.

The intermediate layer may be prepared by coating a coating solution comprising the amino resin, the phenolic resin, the dopant and a solvent, drying the coating, and curing the dried coating.

The curing conditions may be from 80° to 150° C. and from 60 to 15 minutes.

It has been unknown that an amino resin forms a charge transfer complex with iodine or an organic sulfonic acid, giving markedly improved electrical conductivity. However, when the amino resin doped with iodine or organic sulfonic acids is used as an intermediate layer of a photoconductor for electrophotography, the resulting intermediate layer masks the defects of the conductive substrate and imparts excellent electriscal characteristics. It has also been found that when the doped amino resin is copolycondensed with a phenolic resin, its adhesion with the conductive substrate is markedly improved, and that even if left to stand under high-temperature, high-humidity conditions, for instance, the copolycondensate does not show any changes in its characteristics.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Figure 1:
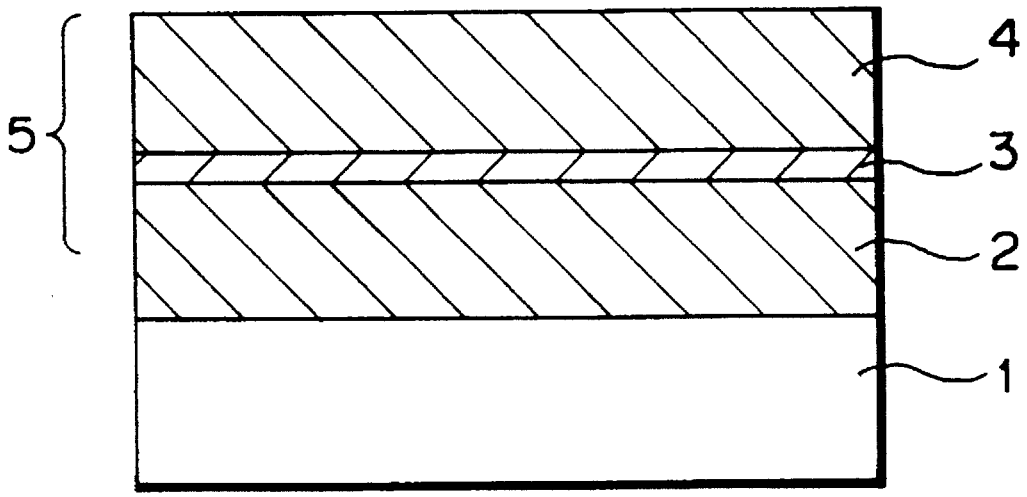
FIG. 1 is a sectional structural view showing a photoconductor according to an embodiment of the present invention.

Hereinafter, the present invention will be described in more detailed by embodiments. However, the present invention should not be contoured as being limited thereto.

The construction of the present invention will be described in detail. The conductive substrate in this invention is a cylinder, a film or a sheet of a metal, or a polymer, earthenware, glass, wood or paper that has been treated to have conductivity. On the conductive substrate is to be provided a cured film of the copolycondensate of an amino resin and a phenolic resin that has been doped, the cured film being relevant to the present invention. As the dopant for the cured film of the copolycondensate of the amino resin and the phenolic resin, there can be used iodine, iron chloride, and sulfonic acid compounds, especially, iodine and aromatic sulfonic acids such as naphthalenesulfonic acid or p-toluenesulfonic acid. The method of forming the cured film comprises dissolving the amino resin and the phenolic resin in a solvent, adding the dopant to the solution, coating the mixture onto the conductive substrate, drying the coating, and then heating it for curing.

The amino resin for use in the invention is a condensation product prepared by reacting an amino compound, such as urea, melamine, acetoguanamine or benzoguanamine, with an aldehyde compound, such as formaldehyde, acetaldehyde, butyraldehyde, furfural, or acrolein, to introduce an alkylol, and etherifying the product with an alcohol. Any of the so prepared amino resins may be used alone or as a copolycondensate. Such amino resins are generally called urea resins, melamine resins, or benzoguanamine resins. Phenolic resins to be copolycondensed with these amino resins during the curing reaction are preferably resol type resins obtained by condensing phenols and aldehydes in the presence of alkaline catalysts. The phenols used are phenol, cresol, xylenol, and alkylphenols such as p-tert-butylphenol or p-tert-amylphenol. The aldehydes used are formaldehyde, paraformaldehyde, acetaldehyde, butyraldehyde, and furfural.

Those amino resins and phenolic resins are easily available as the starting resins for paints. Examples of the amino resins known include UBAN 10S, UBAN 20HS, UBAN 2020, UBAN 134, UBAN 2060 and UBAN 91-55 produced by Mitsui Toatsu Chemicals, Inc., and SUPERBEWCAMINE L-806-60, L-145-60 and TD-126 produced by Dainippon Ink and Chemicals, Inc. Examples of the phenolic resins known include PRIOPHEN 5010, PRIOPHEN 5030, PRIOPHEN TD-447, and SUPERBECCACITE 1001 produced by Dainippon Ink and Chemicals, Inc.

The mixing ratio for the amino resin and the phenolic resin before curing and copolycondensation is preferably 10 to 50 parts by weight of the phenolic resin with respect to 100 parts by weight of the amino resin. Its proportion less than 10 parts by weight is not preferred, because the adhesion of the intermediate layer to the conductive substrate, e.g. an aluminum cylinder, and its adhesion to the photosensitive layer to be applied thereon become poor. The proportion of more than 50 parts by weight results in a low doping effect, which in turn leads to unsatisfactory photoconductors characteristics.

The photoconductors of the present invention is a cured film of the copolycondensate between the amino resin and the phenolic resin that has been doped. Examples of the dopant usable are electron attractive compounds, such as halogen substances or sulfonic acid compounds, which will form charge transfer complexes with amino resins. The suitable examples for the present invention are iodine, aromatic sulfonic acid, such as p-toluenesulfonic acid and 2-naphthalenesulfonic acid. The amount of the dopant added is 4 to 10% by weight of iodine based on the total amount of the resins, 10 to 40% by weight of p-toluenesulfonic acid based thereon, or 20 to 50% by weight of 2-naphthalenesulfonic acid (α-naphthalenesulfonic acid). The dopant and the above resins are used as a coating solution, and dissolved with a suitable solvent, such as methanol, ethanol, tetrahydrofuran, 2-methoxyethyl alcohol, 2-ethoxyethyl alcohol, or ethylene glycol dimethyl ether, before being coated. The coating applied is heated for 10 to 30 minutes at 120° to 150° C. so as to be cured.

In order to prevent the occurrence of a moire ascribed to light returning from the conductive substrate, the intermediate layer of the present invention may have titanium oxide, zinc oxide, silica, kaolin, calcium carbonate, or fine particles of plastic added, and may have an antioxidant or a leveling agent further added.

By so providing the intermediate layer on the conductive substrate and a photosensitive layer on the intermediate layer, a photoconductor can be produced. The photosensitive layer is available in any form, such as a single-layer type photosensitive layer prepared by coating a solution containing a charge generating agent and a charge transfer agent dissolved and dispersed in a resin; a positively charged laminate type photosensitive layer prepared by providing a charge transfer layer, a charge generation layer, and if desired, a conductive layer, in this order; or a negatively charged laminate type photosensitive layer prepared by providing a charge generation layer and a charge transfer layer in this order. The intermediate layer of the present invention is obtained as a smooth, uniform coating even when coated with a large thickness of several tens of micrometers. Thus, it can cover surface defects attributed to scars, dirt or uneven cuts of the conductive substrate that have mainly contributed to decreasing the rate of non-defectives among photoconductors. Particularly with the negatively charged laminate type photosensitive layer, the charge generation layer needs to be coated on the conductive substrate to a very small thickness, say, of 0.01 to 1.0 μm. Thus, the decrease in the rate of non-defectives due to the surface defects of the conductive substrate has posed a major problem. Under these circumstances, the present invention is a particularly effective means as an intermediate layer of a negatively charged laminate type photoconductors comprising a charge generation layer and a charge transfer layer provided in this order on a conductive substrate.

Of the components of the photosensitive layer to be provided on the intermediate layer, the charge generation layer is formed by dispersing a known organic pigment, such as a phthalocyanine pigment, an anthanthrone pigment, a perylene pigment, a perinone pigment, an azo pigment, or a disazo pigment, in a resin, such as polyester, polycarbonate, polyvinyl butyral, polyvinyl acetate, polyvinyl chloride, or acrylic resin. The charge transfer layer to be provided on the charge generation layer is formed by dissolving an enamine compound, a hydrazone compound, a styryl compound, or an amine compound in a suitable solvent together with a film-forming binder compatible with any of such compounds, such as polycarbonate, polyester, polystyrene or-styrene copolymer, coating the solution, and drying the coating. The preferred thickness of the charge transfer layer is 5 to 50 μm.

As set forth above, the intermediate layer of the present invention is formed by dissolving the amino resin and the phenolic resin in a solvent, adding the dopant to the solution, coating the mixture onto the conductive substrate, drying the coating, and then heating and curing it. The thickness of the intermediate layer after drying is 0.1 to 30 μm, preferably 0.5 to 20 μm. If it is less than 0.1 μm, it is difficult to mask the defects of the conductive substrate. The thickness greater than 30 μm is not preferred, because the residual potential becomes high. The conditions for heating and curing may be those in customary use, say, 60 to 15 minutes at 80° to 150° C., preferably 40 to 20 minutes at 100° to 140° C.

The present invention will now be illustrated in greater detail with reference to the following examples based on FIG. 1. FIG. 1 is a sectional structural view showing a photoconductor relevant to an embodiment of the invention.

The photoconductor comprises a photosensitive layer on a conductive substrate, the photosensitive layer 5 comprising an intermediate layer 2, a charge generation layer 3, and a charge transfer layer 4 laminated in this order.

A crude aluminum pipe measuring ϕ30×260.5 L (mm) was prepared as the conductive substrate 1. Its surface was measured for the degree of roughness, which was found to be a maximum of 7.3 μm. Then, a melamine resin (UBAN 20SB, a product of Mitsui Toatsu Chemicals, Inc.) was used as an amino resin to prepare coating solutions as shown in Table 1. Each of the coating solutions was dip-coated onto the crude aluminum pipe so that its thickness after drying would be 20 μm. The coating applied was baked for 20 minutes at 140° C. so as to be cured, thereby forming the intermediate layer 2.

Then, the intermediate layer 2 was dip-coated with a coating solution prepared by dispersing 1 part by weight of X type metal-free phthalocyanine (FASTGEN BLUE 8120B, a product of Dainippon Ink and Chemicals, Inc.) and 1 part by weight of a polyvinyl acetal resin (S-LEC, a product of Sekisui Chemical Co., Ltd.) together with methylene chloride by means of a paint shaker. Thus was formed the charge generation layer 3 with a thickness after drying of 0.2 μm. Onto the charge generation layer 3 was dip-coated a coating solution prepared by dissolving 10 parts by weight of a polycarbonate resin (UPIRON PCZ-300, a product of Mitsubishi Gas Chemical Co., Inc.) and 10 parts by weight of N,N-diethylaminobenzaldehyde diphenylhydrazone in 80 parts by weight of tetrahydrofuran. Thus was formed the charge transfer layer 4 with a thickness after drying of 20 μm. This way, a photoconductor was completed.

TABLE 1

| Coating solution | Dopant | Resin added | Curing agent | Filler | Solvent | Solids content |
|---|---|---|---|---|---|---|
| a | Iodine (4) | PHENOLITE 5030 (20) (Dainippon Ink and Chemicals) | — | Titanium oxide TTO-55(S) (50) (Ishihara Sangyo) | Ethanol | 30% |
| b | Iodine (4) | SUPERB-CCACITE 1001 (20) (Dainippon Ink and Chemicals) | — | — | Methanol | 25% |
| c | Ammonium naphtha-lene-2- | HITAFURAN VF-302 (20) (Hitachi | — | Spherical silica ADMAFINE | Tetrahy-drofuran | 20% |

TABLE 1-continued

| Coating solution | Dopant | Resin added | Curing agent | Filler | Solvent | Solids content |
|---|---|---|---|---|---|---|
| | sulfonate (20) | Kasei Kogyo) | | S0C2 (30) (Tatsumori) | | |
| d | Ammonium naphtha-lene-2-sulfonate (30) | BECCOSOL 1308 (20) (Dainippon Ink and Chemicals) | — | — | Ethanol | 20% |
| e | Iodine (6) | — | Trimellitic anhydride (4) | — | Ethanol | 24% |
| f | Iodine (6) | — | Ammonium benzoate (6) | — | Ethanol | 23% |
| g | p-toluene-sulfonic acid (20) | — | Mesaconic anhydride (6) | | Ethanol | 21% |

Notes:
For the coating solutions in the table, figures in the parentheses represent the amounts (parts by weight) of the resins and the additives incorporated as solids based on 100 parts by weight of the melamine resin as solids.

The so produced photoconductors having the intermediate layer 2 obtained from the coating solutions a, b and c were designated as Examples 1, 2 and 3, respectively. Those having the intermediate layer 2 obtained from the coating solutions d, e, f and g were designated as Comparative Examples 1, 2, 3 and 4, respectively. These photoconductors were each evaluated for the stability of the coating solution, and the adhesion of the photoconductors under normal temperature, normal humidity conditions (25° C. 50 RH %) (hereinafter referred to as N/N) and high temperature, high humidity conditions (60° C. 90 RH %) (hereinafter referred to as H/H). The results are shown in Table 2.

TABLE 2

| | Stability of coating solution | Adhesion N/N | Adhesion H/H |
|---|---|---|---|
| Example 1 | No abnormality after 2 weeks | Good | Good |
| Example 2 | No abnormality after 2 weeks | Good | Good |
| Example 3 | No abnormality after 2 weeks | Good | Good |
| Comparative Example 1 | No abnormality after 1 month | Good | Miliary blister developed in 2 days |
| Comparative Example 2 | Viscosity increased in 3 days | Good | Miliary blister developed in 1 day |
| Comparative Example 3 | No abnormality after 2 weeks | Good | Miliary blister developed in 2 days |
| Comparative Example 4 | Viscosity increased in 1 week | Good | Miliary blister developed in 1 day |

In all of Examples 1 to 3, satisfactory results were obtained. In Comparative Examples 1 to 4, a miliary blister developed in a short time, particularly in regard to the adhesion H/H, demonstrating that the photoconductors of these comparative examples were unusable.

Next, the above photoconductors were each mounted on a laser printer (LASER JET-2, a product of Hewlett Packard), and evaluated for the image quality in the N/N environment (25° C. 50 RH %) and the H/H environment (60° C. 85 RH %). The results are shown in Table 3.

TABLE 3

| | N/N environment | H/H environment |
|---|---|---|
| Example 1 | Good | Good |
| Example 2 | Moire occurred | Moire occurred |
| Example 3 | Moire occurred | Moire occurred |
| Comparative Example 1 | Moire occurred | Fog occurred |
| Comparative Example 2 | Moire occurred | Fog occurred |
| Comparative Example 3 | Moire occurred | Fog occurred |
| Comparative Example 4 | Moire occurred | Fog occurred |

As shown in Table 3, the photoconductors of Comparative Examples 1 to 4 posed the problem of a fog occurring in the resulting image in the H/H environment, while the photoconductors of Examples 1 to 3 caused no fog in the same environment.

According to the present invention, as described above, the amino resin forms a charge transfer complex with iodine or an organic sulfonic acid, thereby markedly improving electrical conductivity as demonstrated in the Examples. Its use as an intermediate layer for an electrophotographic photoconductors, therefore, can mask the defects of the conductive substrate and impart excellent electrical characteristics. Its copolycondensation with a phenolic resin has been found to improve the adhesion of the photosensitive layer to the conductive substrate remarkably, and to enable the photoconductors to show no changes in the characteristics even when left to stand under high temperature and high humidity conditions.

The present invention has been described in detail with respect to preferred embodiments, and it will now be that changes and modifications may be made without departing from the invention in its broader aspects, and it is the intention, therefore, in the appended claims to cover all such changes and modifications as fall within the true spirit of the invention.

What is claimed is:

1. A photoconductor for electrophotography, comprising:

an electroconductive substrate; and a photosensitive layer provided on the electroconductive substrate and comprised of an intermediate layer, a charge generation layer, and a charge transfer layer laminated in this order, wherein the intermediate layer is a doped layer and is comprised of a cured layer of a copolycondensate between an amino resin and a phenolic resin that has been subjected to doping with at least one dopant.

2. The photoconductor for electrophotography as claimed in claim 1, wherein the amino resin is at least one amino resin selected from the group consisting of melamine resins, urea resins and benzoguanamine resins.

3. The photoconductor for electrophotography as claimed in claim 1, wherein the phenolic resin is a phenolic resin derived from resol.

4. The photoconductor for electrophotography as claimed in claim 1, wherein the phenolic resin is a condensate between furfural and formalin.

5. The photoconductor for electrophotography as claimed in claim 1, wherein the intermediate layer is doped with at least one dopant selected from the group consisting of halogen-derived substances and sulfonic acid compounds.

6. The photoconductor for electrophotography as claimed in claim 5, wherein the at least one dopant is iodine.

7. The photoconductor for electrophotography as claimed in claim 5, wherein the at least one dopant is an organic sulfonic acid.

8. The photoconductor for electrophotography as claimed in claim 7, wherein the organic sulfonic acid is α-naphthalenesulfonic acid.

9. The photoconductor for electrophotography as claimed in claim 7, wherein the organic sulfonic acid is p-toluenesulfonic acid.

10. The photoconductor for electrophotography as claimed in claim 1, wherein the phenolic resin is present in an amount ranging from 10 to 50 parts by weight with respect to 100 parts by weight of the amino resin.

11. The photoconductor for electrophotography as claimed in claim 6, wherein the iodine is present in an amount ranging from 4 to 10% by weight based on total resin content.

12. The photoconductor for electrophotography as claimed in claim 8, wherein the α-naphthalenesulfonic acid is present in an amount ranging from 2 to 50% by weight based on total resin content.

13. The photoconductor for electrophotography as claimed in claim 9, wherein the p-toluenesulfonic acid is present in an amount ranging from 10 to 40% by weight based on total resin content.

14. The photoconductor for electrophotography as claimed in claim 1, wherein the intermediate layer further comprises a powder selected from the group consisting of titanium oxide, zinc oxide, silica, kaolin, calcium carbonate, and fine plastic particles.

15. The photoconductor for electrophotography as claimed in claim 1, wherein the intermediate layer has a thickness ranging from 0.2 to 20 μm.

16. The photoconductor for electrophotography as claimed in claim 1, wherein the intermediate layer is prepared by a process comprising:

coating a coating solution comprising the amino resin, the phenolic resin, the at least one dopant and a solvent onto the electroconductive substrate to provide a coating;

drying the coating to provide a dried coating; and curing the dried coating.

17. The photoconductor for electrophotography as claimed in claim 16, wherein the dried coating is cured at a temperature ranging from 80° to 150° C. for a time ranging from 60 to 15 minutes.

18. The photoconductor for electrophotography as claimed in claim 16, wherein the amino resin and the at least one dopant form a charge transfer complex within the coating solution.

19. The photoconductor for electrophotography as claimed in claim 1, wherein the intermediate layer consists essentially of the cured layer of a copolycondensate between an amino resin and a phenolic resin, and wherein the at least one dopant is at least one electron attractive compound.

20. The photoconductor for electrophotography as claimed in claim 19, wherein the at least one electron attractive compound comprises at least one compound selected from the group consisting of halogen-derived substances and sulfonic acid compounds.

* * * * *